US011749201B2

(12) United States Patent
Kim et al.

(10) Patent No.: US 11,749,201 B2
(45) Date of Patent: Sep. 5, 2023

(54) DISPLAY DEVICE, AND CIRCUIT AND METHOD FOR ACQUIRING VOLTAGES

(71) Applicants: HEFEI XINSHENG OPTOELECTRONICS TECHNOLOGY CO., LTD., Anhui (CN); BOE TECHNOLOGY GROUP CO., LTD., Bejing (CN)

(72) Inventors: Taejin Kim, Beijing (CN); Wenchao Bao, Beijing (CN)

(73) Assignees: HEFEI XINSHENG OPTOELECTRONICS TECHNOLOGY CO., LTD, Anhui (CN); BOE TECHNOLOGY GROUP CO., LTD., Beijing (CN)

( * ) Notice: Subject to any disclaimer, the term of this patent is extended or adjusted under 35 U.S.C. 154(b) by 123 days.

(21) Appl. No.: 17/416,561

(22) PCT Filed: Oct. 28, 2020

(86) PCT No.: PCT/CN2020/124498
§ 371 (c)(1),
(2) Date: Jun. 21, 2021

(87) PCT Pub. No.: WO2022/087909
PCT Pub. Date: May 5, 2022

(65) Prior Publication Data

US 2022/0328006 A1 Oct. 13, 2022

(51) Int. Cl.
*G09G 3/3258* (2016.01)
*G09G 3/3233* (2016.01)

(52) U.S. Cl.
CPC ..... *G09G 3/3258* (2013.01); *G09G 3/3233* (2013.01); *G09G 2300/0426* (2013.01);
(Continued)

(58) Field of Classification Search
CPC ..... G09G 3/3258; G09G 3/3233; G09G 2300/0426; G09G 2300/0819;
(Continued)

(56) References Cited

U.S. PATENT DOCUMENTS 9,218,768 B2 * 12/2015 Lee ..... G09G 3/3291
2006/0170623 A1 * 8/2006 Naugler, Jr. ..... G09G 3/2011 345/76

(Continued)

FOREIGN PATENT DOCUMENTS

CN 103854602 A 6/2014
CN 105206208 A 12/2015

(Continued)

OTHER PUBLICATIONS

Novelty search report dated Jun. 16, 2020.

*Primary Examiner* — Tom V Sheng
(74) *Attorney, Agent, or Firm* — Lippes Mathias LLP

(57) ABSTRACT

The present disclosure provides a display device and a circuit and method for acquiring voltages, and belongs to the field of display technologies. The display device includes: a display panel including a plurality of sub-pixels and a plurality of sensing lines, each of the sub-pixels being connected to one of the sensing lines; a reference voltage providing circuit configured to provide a reference voltage; a sampling circuit electrically connected to the sensing lines and the reference voltage providing circuit, respectively, and configured to acquire a voltage on each sensing line to obtain a first sampling value, and acquire the reference voltage provided by the reference voltage providing circuit to obtain a second sampling value; and a processing circuit electrically connected to the sampling circuit, and configured to correct the first sampling value based on the second sampling value and the reference voltage.

18 Claims, 8 Drawing Sheets

(52) U.S. Cl.
CPC ..... *G09G 2300/0819* (2013.01); *G09G 2300/0842* (2013.01); *G09G 2310/08* (2013.01); *G09G 2320/029* (2013.01); *G09G 2320/0233* (2013.01); *G09G 2320/0295* (2013.01); *G09G 2320/043* (2013.01); *G09G 2320/045* (2013.01)

(58) Field of Classification Search
CPC ..... G09G 2300/0842; G09G 2310/08; G09G 2320/029; G09G 2320/043; G09G 2320/045; G09G 2320/0233; G09G 2320/0295
USPC ..... 345/212
See application file for complete search history.

(56) References Cited

U.S. PATENT DOCUMENTS

| | | | | |
|---|---|---|---|---|
| 2013/0050292 | A1* | 2/2013 | Mizukoshi | G09G 3/3233 345/77 |
| 2014/0152642 | A1 | 6/2014 | Kim et al. | |
| 2016/0240122 | A1* | 8/2016 | Yu | G09G 3/2007 |
| 2016/0372050 | A1 | 12/2016 | Kwon et al. | |
| 2017/0004765 | A1* | 1/2017 | Tani | G09G 3/3275 |
| 2018/0114815 | A1* | 4/2018 | Lee | H01L 51/0031 |
| 2018/0218244 | A1 | 8/2018 | Yano et al. | |
| 2019/0043423 | A1* | 2/2019 | Azam | G09G 3/3233 |
| 2019/0066587 | A1* | 2/2019 | Han | H01L 27/1218 |
| 2019/0130824 | A1 | 5/2019 | Tzeng et al. | |
| 2019/0172394 | A1* | 6/2019 | Wang | G09G 3/3258 |
| 2019/0189056 | A1* | 6/2019 | Gai | G09G 3/3233 |
| 2020/0043421 | A1 | 2/2020 | Kang et al. | |
| 2020/0058252 | A1 | 2/2020 | Kim et al. | |
| 2020/0105197 | A1* | 4/2020 | Yin | G09G 3/3258 |
| 2020/0106976 | A1* | 4/2020 | Lee | H04N 25/709 |
| 2020/0160794 | A1 | 5/2020 | Park et al. | |
| 2020/0312246 | A1* | 10/2020 | Xu | G09G 3/3233 |
| 2020/0388220 | A1* | 12/2020 | Xu | G09G 3/3266 |
| 2021/0043148 | A1* | 2/2021 | Lee | G09G 3/3291 |
| 2021/0074210 | A1 | 3/2021 | Yuan et al. | |
| 2021/0225290 | A1* | 7/2021 | Kang | G09G 3/3275 |
| 2021/0335262 | A1* | 10/2021 | Wu | G09G 3/3291 |
| 2021/0366388 | A1 | 11/2021 | Song | |
| 2021/0375207 | A1* | 12/2021 | Chen | G09G 3/3233 |
| 2022/0036818 | A1* | 2/2022 | Yin | G09G 3/3233 |
| 2022/0122529 | A1* | 4/2022 | Meng | G09G 3/3225 |

FOREIGN PATENT DOCUMENTS

| | | | |
|---|---|---|---|
| CN | 108363280 | A | 8/2018 |
| CN | 108597449 | A | 9/2018 |
| CN | 109754733 | A | 5/2019 |
| CN | 110070833 | A | 7/2019 |
| CN | 110570819 | A | 12/2019 |
| CN | 110808011 | A | 2/2020 |
| CN | 110827752 | A | 2/2020 |
| CN | 111199710 | A | 5/2020 |
| CN | 111429848 | A | 7/2020 |

* cited by examiner

DISPLAY DEVICE, AND CIRCUIT AND METHOD FOR ACQUIRING VOLTAGES

This is a 371 of PCT Application No. PCT/CN2020/124498, filed on Oct. 28, 2020, and entitled "DISPLAY DEVICE, AND CIRCUIT AND METHOD FOR ACQUIRING VOLTAGES", the entire contents of which are incorporated herein by reference.

TECHNICAL FIELD

The present disclosure relates to the field of display technologies, and in particular to a display device and a circuit and method for acquiring voltages.

BACKGROUND

In order to improve the display effect of a display panel, external compensation may be performed on the display panel during the display process of the display panels.

SUMMARY

Embodiments of the present disclosure provide a display device and a circuit and method for acquiring voltages.

An embodiment of the present disclosure provides a display device. The display device includes:

a display panel including a plurality of sub-pixels and a plurality of sensing lines, each of the sub-pixels being connected to one of the sensing lines;

a reference voltage providing circuit configured to provide a reference voltage;

a sampling circuit electrically connected to the sensing lines and the reference voltage providing circuit, respectively, and configured to acquire a voltage on each sensing line to obtain a first sampling value, and acquire the reference voltage provided by the reference voltage providing circuit to obtain a second sampling value; and a processing circuit electrically connected to the sampling circuit, and configured to correct the first sampling value based on the second sampling value and the reference voltage.

Optionally, the sampling circuit includes: a calibration pin and an analog-to-digital converter, the calibration pin being electrically connected to the reference voltage providing circuit, and the analog-to-digital converter being electrically connected to the calibration pin and the sensing lines, respectively.

Optionally, the display device further includes a chip-on-film (COF), the sampling circuit being disposed on the COF, the COF having a first side connected to the display panel and a second side opposite to the first side, and the calibration pin being disposed on the second side of the COF.

Optionally, the sampling circuit is integrated on the display panel, and the calibration pin is disposed on a first side of the display panel.

In some embodiments, the number of the calibration pin is one, and the calibration pin is disposed at one end of the first side or in the middle of the first side.

Optionally, the processing circuit is configured to acquire a difference between the second sampling value and the reference voltage, and obtain a corrected first sampling value by subtracting the difference from the first sampling value.

In some embodiments, the number of the calibration pin is two, and the two calibration pins are disposed at two ends of the first side, respectively.

In still other embodiments, the number of the calibration pin is three, one of the three calibration pins is disposed in the middle of the first side, and the other two are disposed at two ends of the first side, respectively.

Optionally, the display panel has at least two sensing areas, the sensing areas corresponding to the calibration pins in a one-to-one correspondence, and an arrangement direction of the sensing areas being the same as that of the calibration pins; and the processing circuit is configured to correct a target first sampling value based on a difference between a target second sampling value and the reference voltage, the calibration pin corresponding to the target second sampling value corresponding to the sensing area where the sensing line corresponding to the target first sampling value is disposed.

Optionally, the reference voltage providing circuit and the processing circuit are integrated on a logic board.

Optionally, a value of the reference voltage is a middle value of an upper limit and a lower limit of a measurement range of the sampling circuit.

An embodiment of the present disclosure also provides a circuit for acquiring voltages of a display panel. The method for acquiring voltages includes:

a reference voltage providing circuit configured to provide a reference voltage;

a sampling circuit electrically connected to a sensing line of the display panel and the reference voltage providing circuit, respectively, and configured to acquire a voltage on the sensing line to obtain a first sampling value, and acquire the reference voltage provided by the reference voltage providing circuit to obtain a second sampling value; and a processing circuit electrically connected to the sampling circuit, and configured to correct the first sampling value based on the second sampling value and the reference voltage.

An embodiment of the present disclosure also provides a method for acquiring voltages of a display panel. The method for acquiring voltages includes:

acquiring a voltage on a sensing line of the display panel to obtain a first sampling value;

acquiring a reference voltage provided by a reference voltage providing circuit to obtain a second sampling value; and correcting the first sampling value based on the second sampling value and the reference voltage.

Optionally, said correcting the first sampling value based on the second sampling value and the reference voltage includes:

acquiring a difference between the second sampling value and the reference voltage, and subtracting the difference from the first sampling value to obtain a corrected first sampling value.

BRIEF DESCRIPTION OF THE DRAWINGS

For clearer descriptions of the technical solutions in the embodiments of the present disclosure, the following briefly introduces the accompanying drawings required for describing the embodiments. Apparently, the accompanying drawings in the following description show merely some embodiments of the present disclosure, and persons of ordinary skill in the art may still derive other drawings from these accompanying drawings without creative efforts.

DETAILED DESCRIPTION

For clearer descriptions of the objectives, technical solutions, and advantages of the present disclosure, embodiments of the present disclosure are described in detail hereinafter referring to the accompanying drawings.

Unless otherwise defined, the technical terms or scientific terms used herein shall have the usual meanings understood by those with ordinary skills in the field to which the present disclosure belongs. Words such as "first", "second", "third" and the like used in the description and claims of the present disclosure do not denote any order, quantity or importance, but are only used to distinguish different components. Similarly, words such as "one" or "a/an" and the like do not mean a quantity limit, but mean that there is at least one. Words such as "comprising" or "including" and the like mean that the elements or items before "comprising" or "including" cover the elements or items listed after "comprising" or "including" and their equivalents, and do not exclude other elements or items. Expressions such as "connected to" or "connected with" and the like are not limited to physical or mechanical connections, but may include electrical connections, whether direct or indirect. Words such as "up", "down", "left", "right" and the like are only used to indicate the relative position relationship. When the absolute position of the described object changes, the relative position relationship may also change accordingly.

In the related art, an external compensation process for a display panel includes: a data drive circuit receives sensing voltages from sub-pixels through sensing lines, converts the sensing voltages into digital sensing values, and then send the digital sensing values to a logic board. The logic board modulates digital video data according to the sensing values to compensate for changes in electrical characteristics of a drive transistor in a corresponding sub-pixel.

However, due to the influence of external noise, the digital sensing value acquired by the data drive circuit may be inaccurate, which affects the effect of external compensation.

An embodiment of the present disclosure provides a display device, which can be any product or component with a display function, such as a mobile phone, a tablet computer, a television, a monitor, a notebook computer, a digital photo frame, a navigator, and the like.

Figure 1:
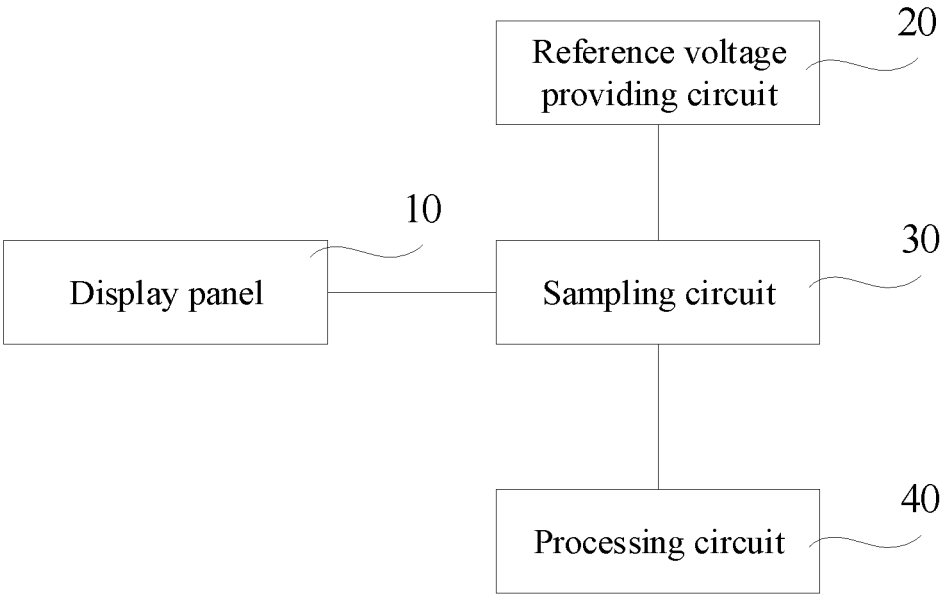
FIG. 1 is a schematic structural diagram of a display device according to an embodiment of the present disclosure.

FIG. 1 is a schematic structural diagram of a display device according to an embodiment of the present disclosure. Referring to FIG. 1, the display device includes a display panel 10, a reference voltage providing circuit 20, a sampling circuit 30 and a processing circuit 40. The sampling circuit 30 is electrically connected to the reference voltage providing circuit 20, the processing circuit 40, and sensing lines of the display panel 10, respectively.

The reference voltage providing circuit 20 is configured to provide a reference voltage. The sampling circuit 30 is configured to acquire a voltage on each sensing line to obtain a first sampling value, and acquire the reference voltage provided by the reference voltage providing circuit 20 to obtain a second sampling value. The processing circuit 40 is configured to correct the first sampling value with the second sampling value.

In the embodiments of the present disclosure, in addition to acquiring the voltage on each sensing line, the sampling circuit also acquires the reference voltage of the reference voltage providing circuit, so that the processing circuit can correct the first sampling value acquired by sampling the voltage on each sensing line based on the second sampling value acquired by sampling the reference voltage and the reference voltage to remove the noise component in the first sampling value and acquire a sensing voltage value, thereby improving the accuracy and reliability of the sensing voltage value. The compensation voltage calculated based on the sensing voltage value is more accurate, and the use of a more accurate compensation voltage to externally compensate the corresponding sub-pixel can improve the display effect of the display panel.

In the embodiments of the present disclosure, the reference voltage may be set according to actual needs, which is not limited in the present disclosure.

In the embodiment of the present disclosure, the display panel 10 may be any display panel that requires external compensation, including but not limited to an OLED display panel. Hereinafter, an OLED display panel will be taken as an example to illustrate the embodiments of the present disclosure.

Optionally, in the embodiments of the present disclosure, the display device is a display device that uses a chip-on-film (COF) packaging process or a display device that uses a chip on panel (COP) packaging process. For display devices adopting different packaging processes, the location of the sampling circuit is different. The two types of display devices will be described below in conjunction with FIG. 2 and FIG. 10, respectively.

Figure 2:
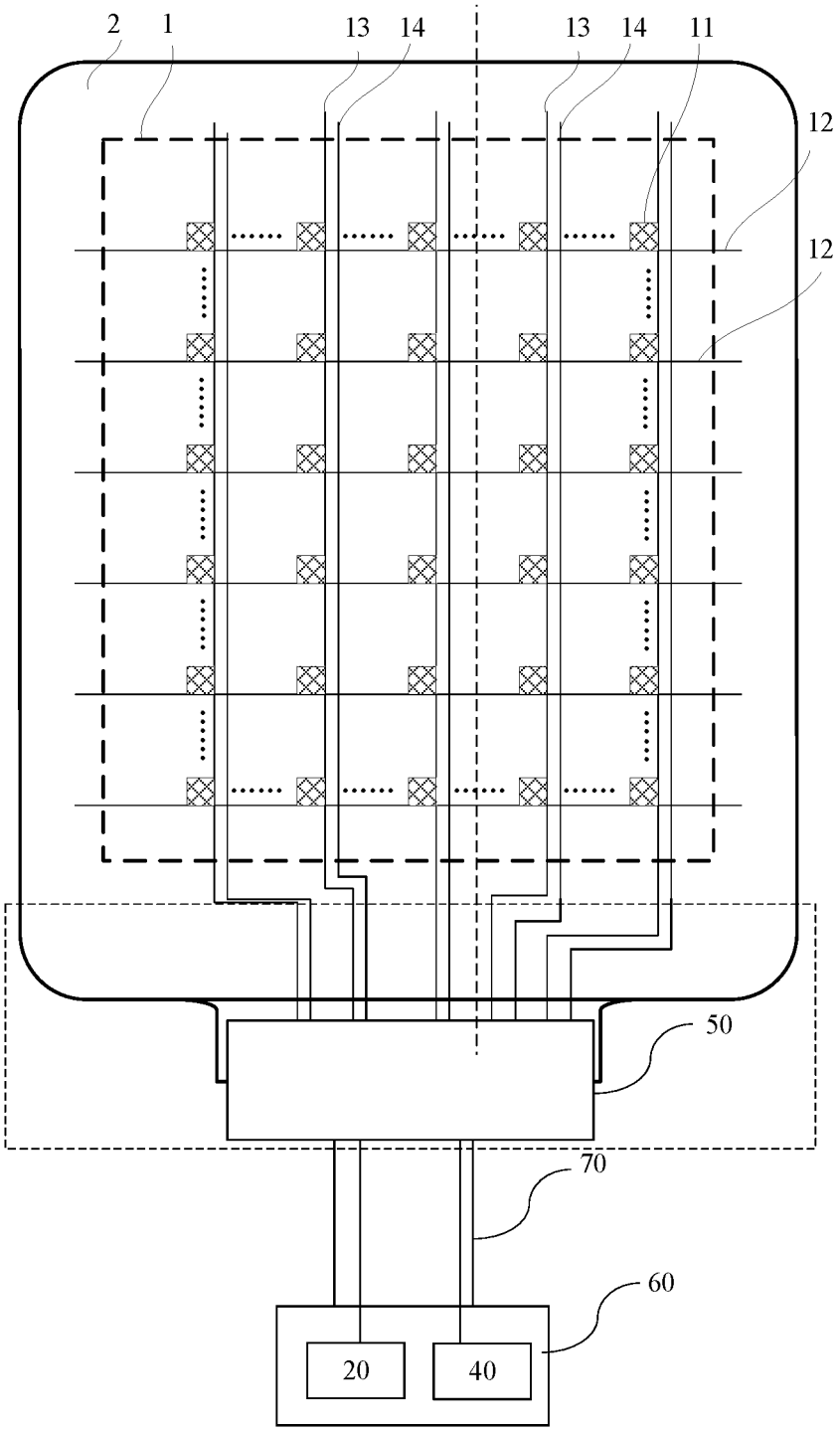
FIG. 2 is a schematic structural diagram of a display device according to an embodiment of the present disclosure.

FIG. 2 is a schematic structural diagram of a display device according to an embodiment of the present disclosure. As shown in FIG. 2, the display device includes a display panel 10 and a COF 50 bound to the display panel 10. That is, the display device shown in FIG. 2 adopts the COF packaging process, and a drive integrated circuit (IC) is disposed on the COF 50. One end of the COF 50 is bonded and connected to the display panel 10, and the other end of the COF 50 is bonded and connected to a circuit board 70.

The circuit board 70 may be at least one of a printed circuit board (PCB) or a flexible printed circuit (FPC).

As shown in FIG. 2, the display panel 10 has a display area 1 and a peripheral area 2 surrounding the display area 1. The display area 1 includes a plurality of sub-pixels 11, a plurality of gate lines 12, a plurality of data lines 13 and a plurality of sensing lines 14. The plurality of gate lines 12 and the plurality of data lines 13 intersect to form a plurality of sub-pixel areas. One sub-pixel 11 is arranged in each sub-pixel area. Each sub-pixel 11 is connected to a corresponding gate line 12 and a corresponding data line 13, respectively. An extending direction of the sensing lines 14 is the same as that of the data lines 13. Each sub-pixel 11 is connected to a corresponding sensing line 14. The peripheral area 2 is used for arranging a gate driver on array (GOA) circuit and various signal lines and signal pins.

In some examples, the gate lines 12 extend in a first direction, and the data lines 13 and the sensing lines 14 extend in a second direction. Assuming that the first direction is a row direction and the second direction is a column direction, one column of sub-pixels 11 is connected to the same sensing line 14, or two columns of sub-pixels 11 are connected to one sensing line 14, as long as each sub-pixel 11 can perform voltage sensing individually through the connected sensing line 14.

For an OLED display panel, a sub-pixel includes a light-emitting device and a sub-pixel circuit. A scan signal is provided to the sub-pixel circuit through the gate line, and a data signal is provided to the sub-pixel circuit through the data line, so that a corresponding light-emitting device is controlled to emit light through the sub-pixel circuit, thereby realizing image display.

Figure 3:
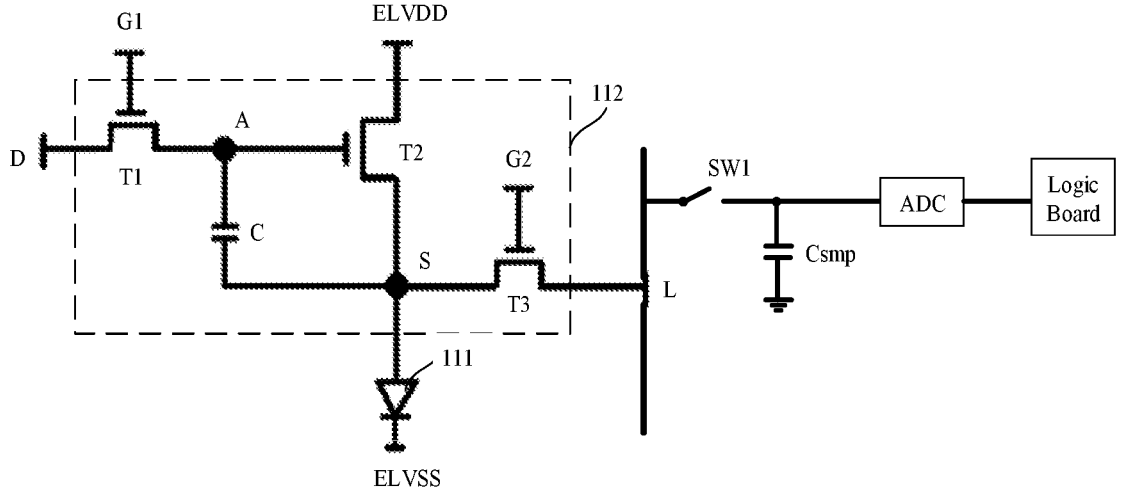
FIG. 3 is a schematic diagram of a circuit structure of a sub-pixel and a sampling circuit according to an embodiment of the present disclosure.

FIG. 3 is a schematic diagram of a circuit structure of a sub-pixel and a sampling circuit according to an embodiment of the present disclosure. As shown in FIG. 3, the sub-pixel 11 includes a light-emitting device 11 and a sub-pixel circuit 112. The sub-pixel circuit 112 includes a first thin-film transistor T1, a second thin-film transistor T2, a third thin-film transistor T3, and a capacitor C. A control electrode of the first thin-film transistor T1 is connected to a first gate line G1. A first electrode of the first thin-film transistor T1 is connected to the data line. A second electrode of the first thin-film transistor T1 is connected to one terminal of the capacitor C and a control electrode of the second thin-film transistor T2. A first electrode of the second thin-film transistor T2 is connected to a first power line ELVDD. A second electrode of the second thin-film transistor T2 is connected to the other terminal of the capacitor, a first electrode of the third thin-film transistor T3 and an anode of the light-emitting device, respectively. A cathode of the light-emitting device is connected to a second power supply line ELVSS. A control electrode of the third thin-film transistor T3 is connected to a second gate line G2. A second electrode of the third thin-film transistor T3 is connected to the sensing line.

The sampling circuit includes a switch SW1, a sampling capacitor Csmp, and an analog-to-digital converter (ADC). One end of the switch SW1 is connected to a sensing line L. The other end of the switch SW1 is connected to one terminal of the sampling capacitor Csmp and an input terminal of the ADC. The other terminal of the sampling capacitor Csmp is grounded. An output terminal of the ADC is connected to a logic board.

In the embodiment of the present disclosure, the control electrode is a gate, the first electrode is one of a source and a drain, and the second electrode is the other of the source and the drain. A voltage provided by the first power line ELVDD is higher than that provided by the second power line ELVSS.

It should be noted that FIG. 3 only takes a 3T1C circuit (i.e., a sub-pixel circuit including 3 transistors and 1 capacitor) as an example to describe the embodiments of the present disclosure, which is not limited in the embodiments of the present disclosure.

Figure 4:
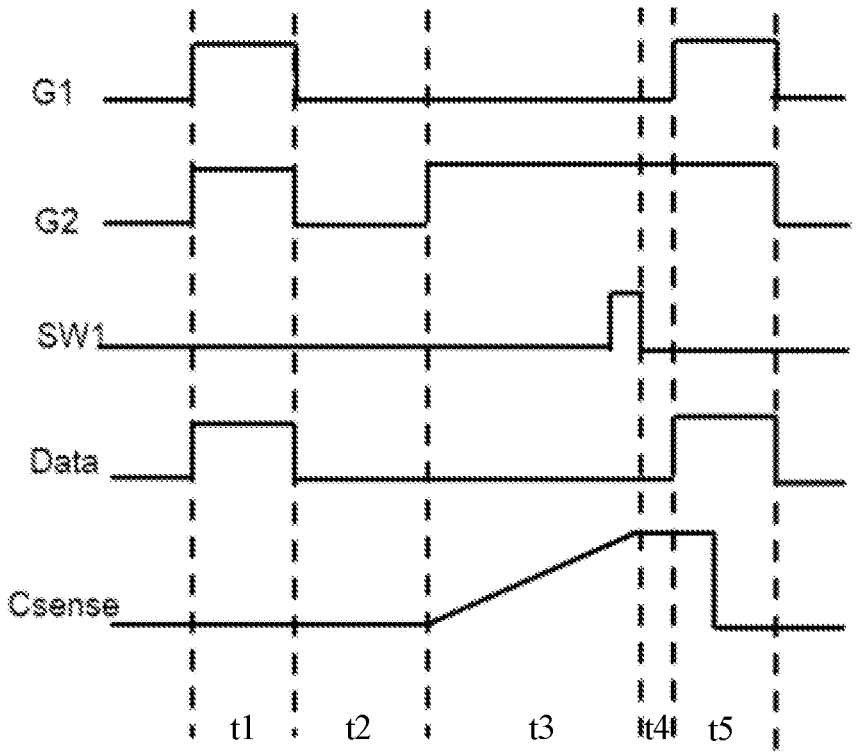
FIG. 4 is a driving timing diagram of sub-pixels in an external compensation process according to an embodiment of the present disclosure.

FIG. 4 is a timing diagram of driving signals in an external compensation process of the circuit structure shown in FIG. 3. The working process of the sub-pixels in FIG. 3 will be described below in conjunction with FIG. 4.

In a writing phase t1, both a first gate line G1 and a second gate line G2 provide a high level, and the first thin-film transistor T1 and the third thin-film transistor T3 are turned on. A data line D writes a data voltage, and at the same time, the second electrode of the second thin-film transistor T2 is reset through the sensing line L, and a voltage difference across both terminals of the capacitor C is VAS.

In a stable phase t2, both the first gate line G1 and the second gate line G2 provide a low level, the first thin-film transistor T1 and the third thin-film transistor T3 are turned off, the data line D stops writing the data voltage, and the voltage across both terminals of the capacitor C remains unchanged.

In a charging phase t3, the first gate line G1 provides a low level, the first thin-film transistor T1 is turned off, the second gate line G2 provides a high level, the third thin-film transistor T3 is turned on, the sensing line L is switched to a floating state, and the sensing line L is charged. Csense in FIG. 4 represents a potential of the sensing line L. As can be seen from FIG. 4, during the charging phase t3, the potential on the sensing line L gradually rises. In the last period of the charging phase t3, a switch control line (not shown) provides a high level, the switch SW1 is turned on, and the sampling capacitor Csmp is charged.

In a sampling phase t4, both the first gate line G1 and the second gate line G2 provide a low level, the first thin-film transistor T1 and the third thin-film transistor T3 are turned off, the ADC acquires the voltage on the sampling capacitor Csmp, that is, acquires the voltage on the sensing line L to obtain a first sampling value, and transfers the first sampling value to the logic board, and the logic board calculates a compensation voltage based on the first sampling value.

In a write-back phase t5, both the first gate line G1 and the second gate line G2 provide a high level, the first thin-film transistor T1 and the third thin-film transistor T3 are turned on, and the data line D writes the compensation voltage to point A, which compensation voltage turns on the second thin-film transistor T2, and the light-emitting device 111 emits light.

It should be noted that, in some embodiments, the stable phase t2 in FIG. 4 can be removed, and the charging phase t3 is directly after the writing phase t1.

Figure 5:
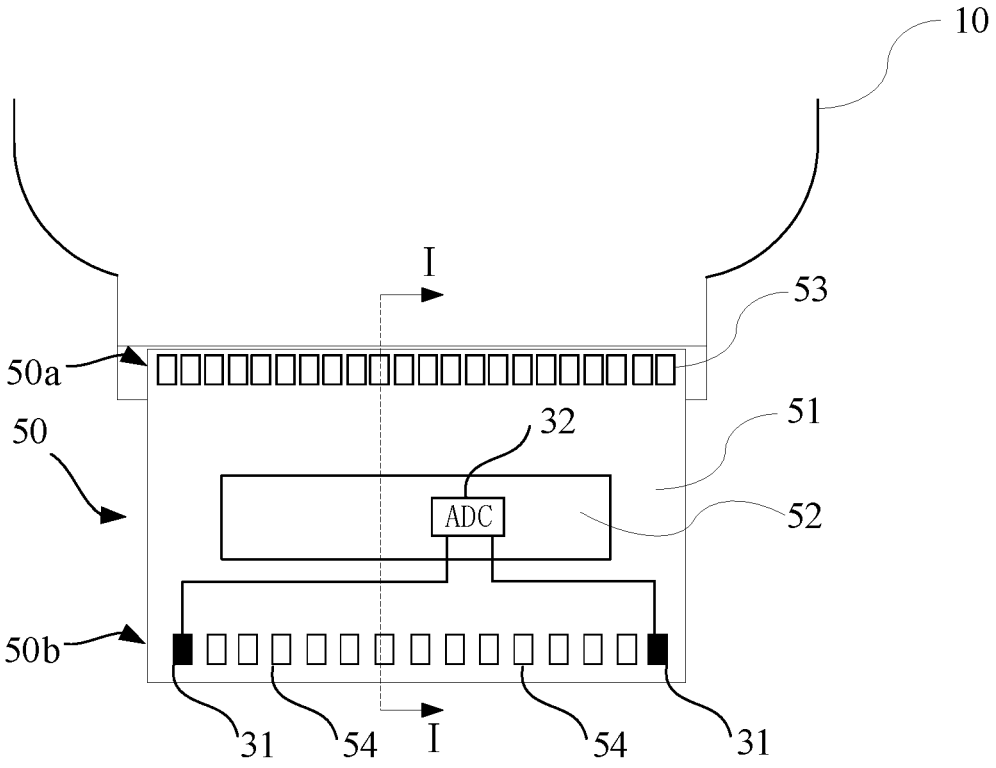
FIG. 5 is a schematic diagram of a partially enlarged structure of the display device shown in FIG. 2.

FIG. 5 is a partially enlarged schematic diagram of the structure in FIG. 2, showing the structure of the part in the dashed block in FIG. 2. In conjunction with FIGS. 2 and 5, optionally, the sampling circuit 30 includes a calibration pin 31 and an ADC 32. The calibration pin 31 is electrically connected to the reference voltage providing circuit 20. The ADC 32 is electrically connected to the calibration pin 31 and the sensing line 14, respectively.

The sampling circuit 30 further includes a switch and a sampling capacitor connected between the calibration pin 31 and the ADC 32 to control the sampling of the ADC 32. For the connection mode and control process of the switch and the sampling capacitor, reference may be made to the related descriptions of FIGS. 3 and 4, and the detailed description is omitted here.

In the embodiments of the present disclosure, the ADC is usually integrated in the drive IC of the display panel, and in the display device shown in FIG. 2 and FIG. 5, the drive IC is integrated in the COF. Therefore, in the embodiment shown in FIG. 2, the sampling circuit 30 is disposed on the COF 50. In addition to the sampling circuit, the drive IC further includes a digital-to-analog converter for supplying the data voltage to the data line.

In an exemplary embodiment, a value of the reference voltage is a middle value of an upper limit and a lower limit of a measurement range of the sampling circuit. For example, if the lower limit of the measurement range is 1V and the upper limit is 4V, the reference voltage is 2.5V. The measurement range of the sampling circuit is determined by the range of the ADC. When the measured value is at an end of the range of the ADC, the resulting measurement error is relatively large compared to the measured value in a middle area of the range of the ADC. Therefore, the reference voltage being taken as the middle value of the upper limit and the lower limit of the measurement range helps to improve the accuracy of the reference voltage measurement result.

Figure 6:
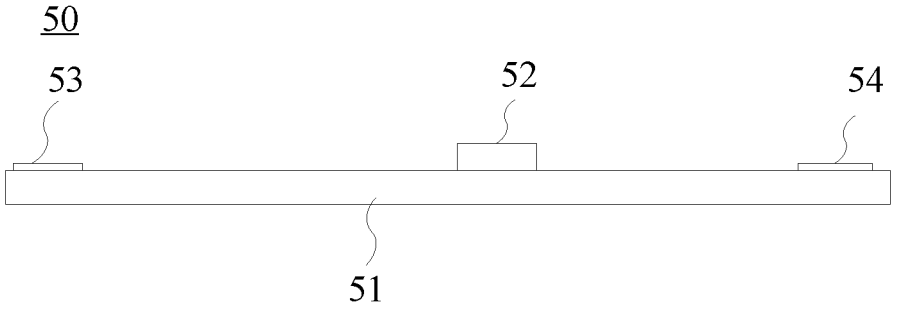
FIG. 6 is a schematic diagram of a cross-sectional structure of a chip-on-film.

FIG. 6 is a schematic diagram of a cross-sectional structure of the COF in FIG. 5, showing the cross-sectional structure of the COF along a line I-I in FIG. 5. With reference to FIGS. 5 and 6, the COF 50 includes a flexible substrate 51, a drive IC 52, a plurality of first pins 53 and a plurality of second pins 54. The drive IC 52, the plurality of first pins 53 and the plurality of second pins 54 are all disposed on the flexible substrate 51. The drive IC 52 is electrically connected to the first pins 53 and the second pins 54, respectively.

Optionally, the flexible substrate 51 may be a single-layered substrate or a multi-layered substrate. When the flexible substrate 51 is a multi-layered substrate, the flexible substrate 51 includes an insulating dielectric layer and a conductive layer alternately stacked. A plurality of signal lines connected between the drive IC 52 and the first pin 53 and a plurality of signal lines (not shown) connected between the drive IC 52 and the second pin 54 may be disposed in the same conductive layer, and may also be disposed in different conductive layers. When the number of the first pins 53 and the second pins 54 is large, more signal lines need to be arranged. Adopting a multi-layered substrate and arranging the signal lines in a plurality of conductive layers can facilitate the arrangement of the signal lines.

In an exemplary embodiment, the chip-on-film 50 has a first side 50*a* and a second side 50*b* opposite to each other. The plurality of first pins 53 are arranged along the first side 50*a*. The plurality of second pins 54 are arranged along the second side 50*b*. The first pins 53 include a sensing pin, a data pin, and the like, which are connected to the circuit structure in the display panel 10. The sensing pin is connected to a sensing line 14 in the display panel. The data pin is connected to a data line 13 in the display panel. The second pin 54 includes the calibration pin 31 and the like.

The chip-on-film 50 and the display panel 10 are usually connected in an outer lead bonding (OLB) process. In the OLB process, an anisotropic conductive film (ACF) is provided between the chip-on-film 50 and a surface to be contacted of the display panel 10. The plurality of first pins 53 are connected to corresponding pins on the display panel 10 through the ACF. The plurality of second pins 54 may be connected to other structures, such as a printed circuit board (PCB) in an inner lead bonding (ILB) process.

Optionally, the calibration pin 31 is disposed at at least one end of the first side and/or in the middle of the first side.

FIG. 5 is a schematic structural diagram of a COF according to an embodiment of the present disclosure. As shown in FIG. 5, in another implementation of the embodiment of the present disclosure, the COF 50 has two calibration pins 31 which are, respectively disposed at both ends of the second side 50*b*. In this case, other second pins 54 except for the calibration pins 31 are disposed in the middle of the two calibration pins 31. In this way, adding the calibration pins without changing the sequence of other second pins is easy to implement.

Figure 7:
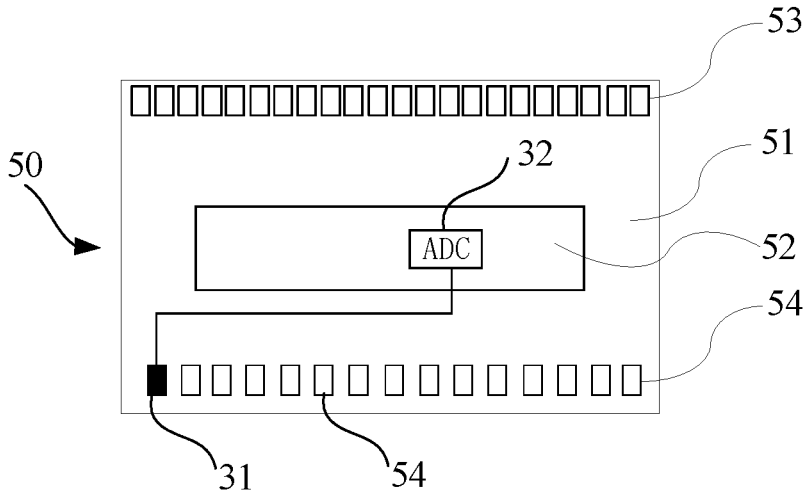
FIG. 7 is a schematic diagram of the distribution of a calibration pin according to an embodiment of the present disclosure.

FIG. 7 is a schematic structural diagram of a COF according to an embodiment of the present disclosure. In an implementation of the embodiment of the present disclosure, as shown in FIG. 7, the COF 50 has one calibration pin 31 which is disposed at one end of the second side 50*b*. In this case, the other second pins 54 except for the calibration pin 31 are all disposed on one side of the calibration pin 31. In this way, adding the calibration pin without changing the sequence of other second pins is easy to implement.

Figure 8:
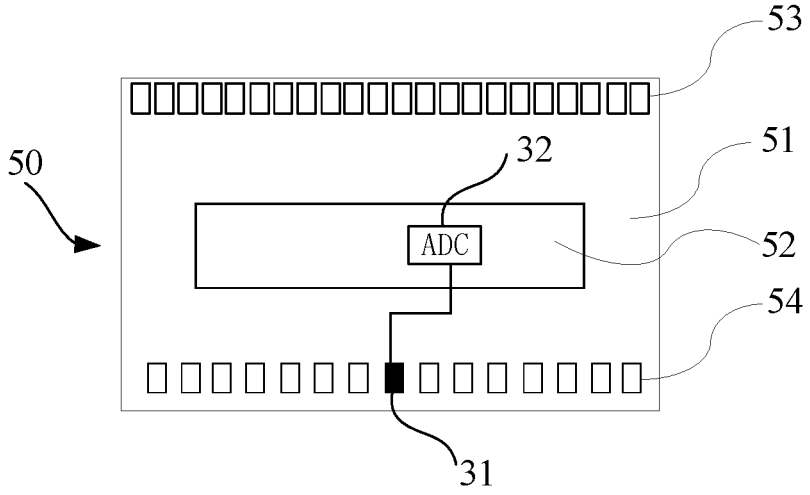
FIG. 8 is a schematic diagram of the distribution of a calibration pin according to an embodiment of the present disclosure.

FIG. 8 is a schematic structural diagram of another COF according to an embodiment of the present disclosure. As shown in FIG. 8, in another implementation of the embodiment of the present disclosure, the COF 50 has one calibration pin 31 which is disposed in the middle of the second side 50*b*. In this case, the other second pins 54 except for the calibration pin 31 are distributed on both sides of the calibration pin 31.

Figure 9:
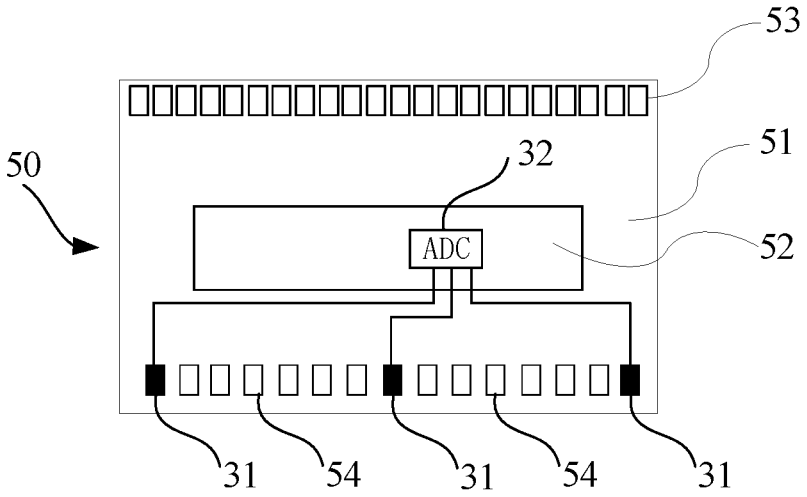
FIG. 9 is a schematic diagram of the distribution of another calibration pin according to an embodiment of the present disclosure.

FIG. 9 is a schematic structural diagram of another COF according to an embodiment of the present disclosure. As shown in FIG. 9, in another implementation of the embodiment of the present disclosure, the COF 50 has three calibration pins 31. Two of the three calibration pins 31 are, respectively disposed at both ends of the second side 50*b*, and one is disposed in the middle of the second side 50*b*. In this case, the other second pins 54 except for the calibration pins 31 are distributed among the three calibration pins 54.

It should be noted that the numbers of the first pins 53 and the second pins 54 shown in FIG. 5 to FIG. 8 are only examples, and can be set according to actual needs, which is not limited in the present disclosure.

In the embodiment of the present disclosure, the processing circuit 40 is configured to correct the first sampling value based on a difference between the second sampling value and the reference voltage.

In an exemplary embodiment, the processing circuit 40 is configured to acquire the difference between the second sampling value and the reference voltage, and obtain a corrected first sampling value by subtracting the difference from the first sampling value. That is, the processing circuit 40 corrects the first sampling value according to equation (1), and the corrected first sampling value is the sensing voltage.

$$V=A-(B-V0) \tag{1}$$

In equation (1), V is the sensing voltage, A is the first sampling value, B is the second sampling value, and V0 is the reference voltage. B-V0 represents external noise.

In the case of having one calibration pin (e.g., FIG. 6 or FIG. 7), the first sampling values corresponding to all the sensing lines are corrected with the second sampling value corresponding to the same calibration pin.

In the case of having at least two calibration pins (e.g., FIG. 5 or FIG. 9), the display panel has at least two sensing areas, and the first sampling values corresponding to the sensing lines in the different sensing areas are corrected with the second sampling values corresponding to different calibration pins.

When the sampling circuit has at least two calibration pins, the number of the sensing areas is the same as the number of the calibration pins. In addition, an arrangement direction of the sensing areas is the same as that of the calibration pins, and the sensing areas and the calibration pins are in a one-to-one correspondence according to the arrangement direction. For COF, different sensing areas correspond to different sensing pin groups, and the sensing pin groups correspond to the sensing areas one-to-one. The sensing pins in each sensing pin group are connected to the sensing lines in a corresponding sensing area, so that the sampling circuit can acquire the first sampling values corresponding to the sensing lines in different sensing areas through different sensing pin groups.

The processing circuit 40 is configured to correct a target first sampling value based on a difference between a target second sampling value and the reference voltage. The calibration pin corresponding to the target second sampling value corresponds to the sensing area where the sensing line corresponding to the target first sampling value is disposed.

For example, as shown in FIG. 2, the display panel has two sensing areas, which are, respectively disposed on both sides of a dotted line O, that is, arranged along the direction from left to right in FIG. 2. With reference to FIG. 5, there are two calibration pins 31, in which the calibration pin 31 on the left corresponds to the sensing area on the left of the dashed line O, and the calibration pin 31 on the right corresponds to the sensing area on the right of the dashed line O. The first sampling value on the sensing line in the sensing area on the left of the dashed line O is corrected with the second sampling value acquired through the calibration pin 31 on the left. The first sampling value on the sensing line in the sensing area on the left of the dashed line O is corrected with the second sampling value acquired through the calibration pin 31 on the right.

In the embodiments of the present disclosure, when a plurality of calibration pins exists, by dividing the sensing area, the first sampling values on the sensing lines in different sensing areas are corrected with the second sampling values on different calibration pins. Since the sensing line and the calibration pin close to each other are more likely to suffer from interference proximity, correcting the first sampling value with the second sampling value at the corresponding position is beneficial to further improve the accuracy of the acquired sensing voltage and further improve the compensation effect of the display panel.

Optionally, as shown in FIG. 2, the display device further includes a logic board 60. The reference voltage providing circuit 20 and the processing circuit 40 are integrated on the logic board 60. The second side 50*b* of the COF 50 is connected to the logic board 60 through the circuit board 70, so that the calibration pin is electrically connected to the reference voltage providing circuit 20 in the logic board 60, and the ADC is electrically connected to the processing circuit 40, and then the processing circuit 40 can acquire the first sampling value and the second sampling value acquired by the sampling circuit 30.

Alternatively, in other embodiments, the second side 50*b* of the COF 50 may also be directly bound and connected to the logic board 60.

Alternatively, in other embodiments, the display device further includes a PCB, an FPC, and a logic board. The reference voltage providing circuit 20 is disposed on the PCB. The second side of the COF is connected to the PCB, so that the calibration pin is electrically connected to the reference voltage providing circuit 20. The processing circuit 40 is integrated on the logic board. The logic board is connected to the COF through the flexible circuit board and the printed circuit board in turn, so that the processing circuit 40 on the logic board is electrically connected to the sampling circuit 30 on the COF, and then the processing circuit 40 can acquire the first sampling value and the second sampling value acquired by the sampling circuit 30.

In an exemplary embodiment, the processing circuit 40 is a field-programmable gate array (FPGA) on the logic board. A calibration voltage is pre-stored in the FPGA, so that after the first sampling value and the second sampling value are acquired, the first sampling value can be corrected based on the second sampling value and the reference voltage.

Figure 10:
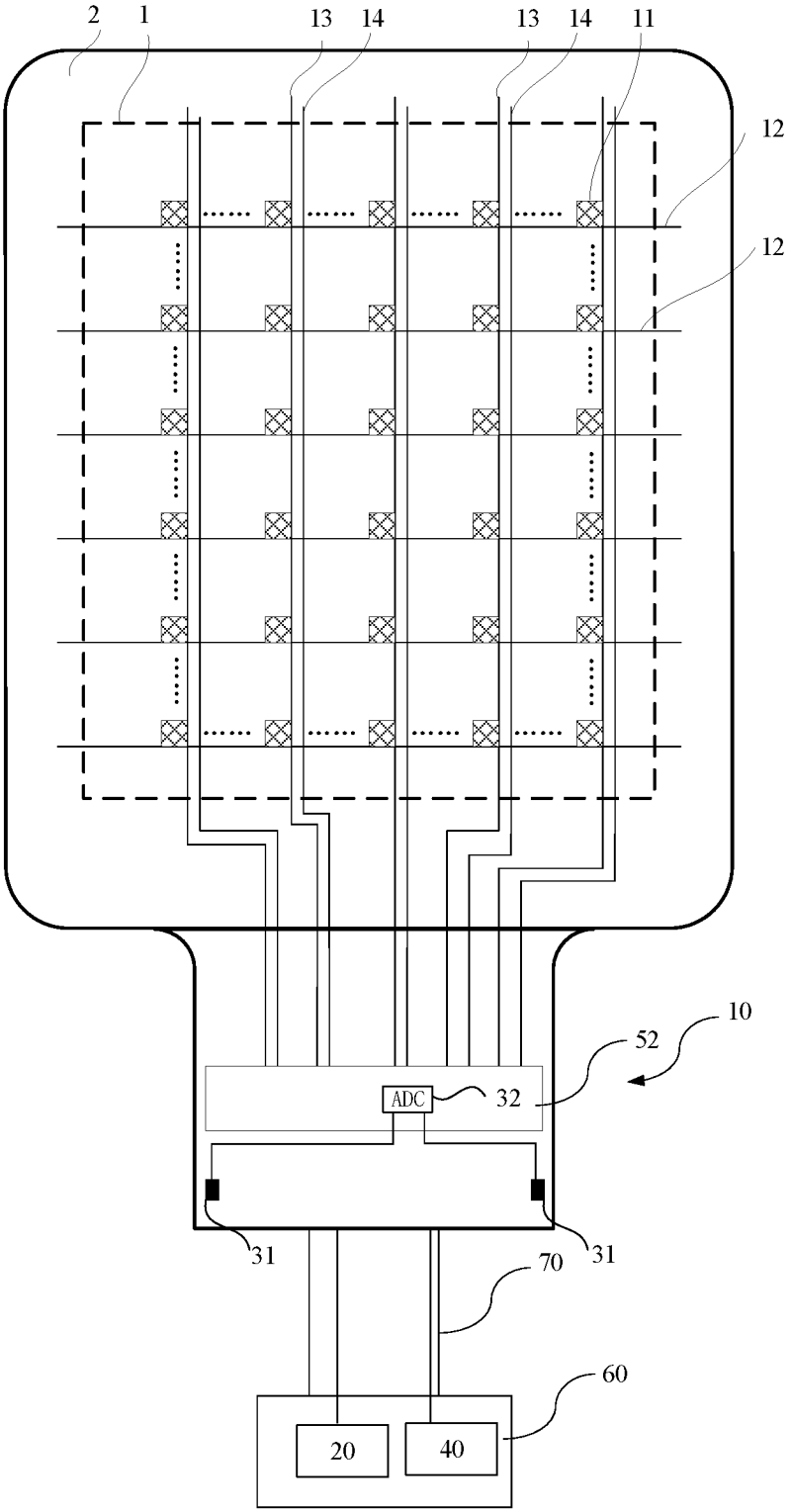
FIG. 10 is a schematic structural diagram of another display device according to an embodiment of the present disclosure.

FIG. 10 is a schematic structural diagram of another display device according to an embodiment of the present disclosure. The difference from the display device shown in FIG. 2 lies in that the display device shown in FIG. 10 does not include the COF, and the drive IC 52 is disposed on the display panel 10, in which the package form of the drive IC is called COP. Accordingly, the sampling circuit is integrated on the display panel 10. That is, the calibration pin 31 and the ADC 32 are both disposed on the display panel 10.

In the display device shown in FIG. 10, the calibration pin 31 is disposed on the first side of the display panel 10, that is, the side of the display panel for connecting with the logic board 60. For the number and arrangement of the calibration pins 31, reference may be made to FIG. 5 to FIG. 8, and detailed description is omitted here. It should be noted that in addition to the calibration pin 31, a plurality of other pins is also arranged on the first side.

In the embodiments of the present disclosure, the pins may also be referred to as pads, and the logic board may also be referred to as a timing controller (T-CON) board.

Figure 11:
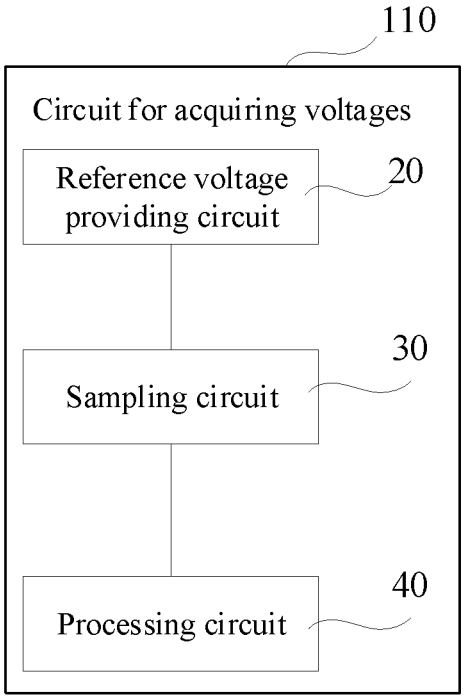
FIG. 11 is a schematic structural diagram of a circuit for acquiring voltages according to an embodiment of the present disclosure.

In addition, an embodiment of the present disclosure also provides a circuit for acquiring voltages, which is suitable for display panels that require external compensation. FIG. 11 is a schematic structural diagram of a circuit for acquiring voltages according to an embodiment of the present disclosure. As shown in FIG. 11, the circuit for acquiring voltages 110 includes a reference voltage providing circuit 20, a sampling circuit 30 and a processing circuit 40.

The reference voltage providing circuit 20 is configured to provide a reference voltage. The sampling circuit 30 is configured to be electrically connected to a sensing lines of the display panel and the reference voltage providing circuit, respectively. The sampling circuit 30 is configured to acquire a voltage on each sensing line to obtain a first sampling value, and to acquire the reference voltage provided by the reference voltage to obtain a second sampling value. The processing circuit 40 is electrically connected to the sampling circuit 30. The processing circuit 40 is configured to correct the first sampling value based on the second sampling value and the reference voltage.

In an exemplary embodiment, as described above, the reference voltage providing circuit is disposed on a printed circuit board or a logic board. The sampling circuit is integrated in a data drive IC. The drive IC adopts a COF package form or a COF package form. The processing circuit is disposed on the logic board.

For the structure of the sampling circuit 30, reference may be made to the foregoing embodiment of the display device, and detailed description is omitted here.

Figure 12:
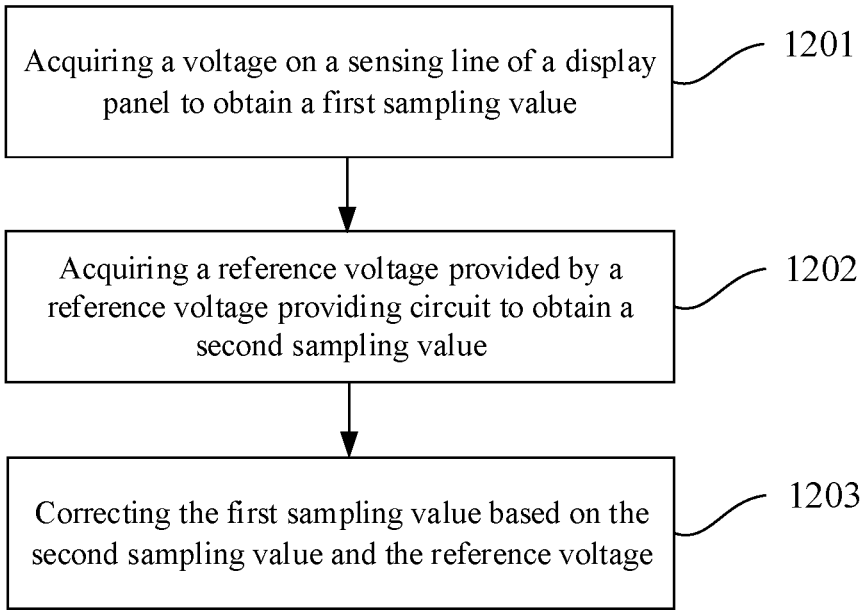
FIG. 12 is a schematic flowchart of a method for acquiring voltages according to an embodiment of the present disclosure.

An embodiment of the present disclosure also provides a method for acquiring voltages, which is applicable to any of the foregoing display devices. The method for acquiring voltages can be executed by the logic board of the display device. FIG. 12 is a schematic flowchart of a method for acquiring voltages according to an embodiment of the present disclosure. As shown in FIG. 12, the method includes the following steps.

In step 1201, a voltage on a sensing line of a display panel is acquired to obtain a first sampling value.

In step 1202, a reference voltage provided by a reference voltage providing circuit is acquired to obtain a second sampling value.

In step 1203, the first sampling value is corrected based on the second sampling value and the reference voltage.

In steps 1201 and 1202, both the first sampling value and the second sampling value are acquired by a sampling circuit (for example, ADC) in a drive IC.

In step 1203, for the manner of correcting the first sampling value, reference may be made to the foregoing display device embodiment, and detailed description is omitted here.

In an exemplary embodiment, a computer-readable storage medium is also provided. The computer-readable storage medium is a non-volatile storage medium, and stores a computer program. The computer program in the computer-readable storage medium, when being executed by a processor, can perform the method for acquiring voltages according to the embodiment of the present disclosure.

In an exemplary embodiment, a computer program product is also provided. The computer program product stores instructions. The instructions, when running on a computer, enable the computer to execute the method for acquiring voltages according to the embodiment of the present disclosure.

In an exemplary embodiment, a chip is also provided. The chip includes a programmable logic circuit and/or program instructions. The chip, when running, can perform the method for acquiring voltages according to the embodiment of the present disclosure.

Described above are merely optional embodiments of the present disclosure, but are not intended to limit the present disclosure. Any modifications, equivalent replacements, improvements and the like made within the spirit and principles of the present disclosure should be included within the scope of protection of the present disclosure.

What is claimed is:

1. A display device, comprising:

a display panel comprising a plurality of sub-pixels and a plurality of sensing lines, each of the sub-pixel being connected to one of the sensing lines;

a reference voltage providing circuit configured to provide a reference voltage, wherein a value of the reference voltage is a middle value of an upper limit and a lower limit of a measurement range of the sampling circuit;

a sampling circuit, electrically connected to the sensing lines and the reference voltage providing circuit, respectively, and configured to acquire a voltage on each sensing line to obtain a first sampling value, and acquire the reference voltage provided by the reference voltage providing circuit to obtain a second sampling value; and a processing circuit, electrically connected to the sampling circuit, and configured to correct the first sampling value based on the second sampling value and the reference voltage.

2. The display device according to claim 1, wherein the sampling circuit comprises: a calibration pin and an analog-to-digital converter, the calibration pin being electrically connected to the reference voltage providing circuit, and the analog-to-digital converter being electrically connected to the calibration pin and the sensing lines, respectively.

3. The display device according to claim 2, further comprising: a chip-on-film, the sampling circuit being disposed on the chip-on-film, the chip-on-film having a first side connected to the display panel and a second side opposite to the first side, and the calibration pin being disposed on the second side of the chip-on-film.

4. The display device according to claim 3, wherein the number of the calibration pin is one, and the calibration pin is one of a pin at one end of the first side and a pin in the middle of the first side.

5. The display device according to claim 4, wherein the processing circuit is configured to acquire a difference between the second sampling value and the reference voltage, and obtain a corrected first sampling value by subtracting the difference from the first sampling value.

6. The display device according to claim 3, wherein the number of the calibration pin is two, and the two calibration pins are arranged along the first side and are disposed at two ends of the first side, respectively.

7. The display device according to claim 6, wherein the display panel has at least two sensing areas, the sensing areas corresponding to the calibration pins in a one-to-one correspondence, and an arrangement direction of the sensing areas being the same as an arrangement direction of the calibration pins; and the processing circuit is configured to correct a target first sampling value based on a difference between a target second sampling value and the reference voltage, wherein a calibration pin corresponding to the target second sampling value corresponds to a sensing area where a sensing line corresponding to the target first sampling value is disposed.

8. The display device according to claim 3, wherein the number of the calibration pin is three, the three calibration pins are arranged along the first side, one of the three calibration pins is disposed in the middle of the first side, and the other two of the three calibration pins are disposed at two ends of the first side, respectively.

9. The display device according to claim 2, wherein the sampling circuit is integrated on the display panel, and the calibration pin is disposed on a first side of the display panel.

10. The display device according to claim 9, wherein the number of the calibration pin is one, and the calibration pin is one of a pin at one end of the first side and a pin in the middle of the first side.

11. The display device according to claim 10, wherein the processing circuit is configured to acquire a difference between the second sampling value and the reference voltage, and obtain a corrected first sampling value by subtracting the difference from the first sampling value.

12. The display device according to claim 9, wherein the number of the calibration pin is two, and the two calibration pins are arranged along the first side and are disposed at two ends of the first side, respectively.

13. The display device according to claim 12, wherein the display panel has at least two sensing areas, the sensing areas corresponding to the calibration pins in a one-to-one correspondence, and an arrangement direction of the sensing areas being the same as an arrangement direction of the calibration pins; and the processing circuit is configured to correct a target first sampling value based on a difference between a target second sampling value and the reference voltage, wherein a calibration pin corresponding to the target second sampling value corresponds to a sensing area where a sensing line corresponding to the target first sampling value is disposed.

14. The display device according to claim 9, wherein the number of the calibration pin is three, the three calibration pins are arranged along the first side, one of the three calibration pins is disposed in the middle of the first side, and the other two of the three calibration pins are disposed at two ends of the first side, respectively.

15. The display device according to claim 14, wherein the display panel has at least two sensing areas, the sensing areas corresponding to the calibration pins in a one-to-one correspondence, and an arrangement direction of the sensing areas being the same as an arrangement direction of the calibration pins; and the processing circuit is configured to correct a target first sampling value based on a difference between a target second sampling value and the reference voltage, wherein a calibration pin corresponding to the target second sampling value corresponds to a sensing area where a sensing line corresponding to the target first sampling value is disposed.

16. The display device according to claim 1, further comprising a logic board, the reference voltage providing circuit and the processing circuit being integrated on the logic board.

17. A circuit for acquiring voltages of a display panel, comprising:

a reference voltage providing circuit configured to provide a reference voltage, wherein a value of the reference voltage is a middle value of an upper limit and a lower limit of a measurement range of the sampling circuit;

a sampling circuit electrically connected to a sensing line of the display panel and the reference voltage providing circuit, respectively, and configured to acquire a voltage on the sensing line to obtain a first sampling value, and acquire the reference voltage provided by the reference voltage providing circuit to obtain a second sampling value; and a processing circuit electrically connected to the sampling circuit, and configured to correct the first sampling value based on the second sampling value and the reference voltage.

18. A method for acquiring voltages for a display panel, comprising:

acquiring a voltage on a sensing line of the display panel to obtain a first sampling value;

acquiring a reference voltage provided by a reference voltage providing circuit to obtain a second sampling value; and correcting the first sampling value based on the second sampling value and the reference voltage;

wherein correcting the first sampling value based on the second sampling value and the reference voltage comprises:

acquiring a difference between the second sampling value and the reference voltage, and subtracting the difference from the first sampling value to obtain a corrected first sampling value.

* * * * *